US005211037A

United States Patent [19]

Adamski et al.

[11] Patent Number: 5,211,037

[45] Date of Patent: May 18, 1993

[54] CONTROLLER FOR WASHING MACHINE WITH ALTERNATELY REVERSING DRIVE MOTOR

[75] Inventors: Joseph R. Adamski, Sudbury; Christopher Ferguson, Framingham; J. Scott Petty, Hanover, all of Mass.; William J. Quandt, Ripon, Wis.

[73] Assignee: Raytheon Company, Lexington, Mass.

[21] Appl. No.: 566,739

[22] Filed: Aug. 13, 1990

[51] Int. Cl.[5] ..... D06F 33/02

[52] U.S. Cl. ..... 68/12.16; 68/12.23

[58] Field of Search ..... 68/12.16, 12.23, 12.01

[56] References Cited

U.S. PATENT DOCUMENTS

| | | | |
|---|---|---|---|
| 2,957,329 | 10/1960 | Re | 68/12.16 |
| 3,003,090 | 10/1961 | Neyhouse et al. | 68/12.23 X |
| 3,095,534 | 6/1963 | Cockrell | 68/12.16 |
| 3,264,544 | 8/1966 | Bowers | 68/12.16 X |
| 3,369,381 | 2/1968 | Crane et al. | 68/12.16 |
| 4,150,303 | 4/1979 | Armstrong | 68/12.16 X |
| 4,241,400 | 12/1980 | Kiefer | 134/58 D X |
| 4,449,384 | 5/1984 | Jones | 68/12.21 |
| 4,542,633 | 9/1985 | Hirooka et al. | 68/12.16 X |
| 4,584,732 | 4/1986 | Kohsaka | 68/12.23 X |
| 4,779,431 | 10/1988 | Burk et al. | 68/12.16 |
| 4,972,134 | 11/1990 | Getz et al. | 68/12.16 X |
| 4,986,092 | 1/1991 | Sood et al. | 68/12.16 |
| 5,005,382 | 4/1991 | Duve | 68/12.16 |

FOREIGN PATENT DOCUMENTS

| | | | |
|---|---|---|---|
| 2735807 | 2/1979 | Fed. Rep. of Germany | 68/12.01 |
| 62-14320 | 4/1987 | Japan | 68/12.23 |

OTHER PUBLICATIONS 364,976, Apr. 1990, European Patent Application 68/12.01.

*Primary Examiner*—Frankie L. Stinson

*Attorney, Agent, or Firm*—William R. Clark; Richard M. Sharkansky

[57] ABSTRACT

A controller for a washing machine with an alternately reversing drive motor wherein an electromechanical timer interfaces in conventional manner to electrical devices, and also switches line voltage to predetermined ones of a plurality of control lines to provide an encoded signal corresponding to the selected agitator stroke profile. The line voltage on the control lines is shifted to a DC voltage level compatible with a microprocessor that decodes the encoded signal, and then provides high rate control signals that gate high power solid state switches that switch line voltage to the respective stator windings of a permanent split capacitor motor. In such manner, the motor is driven in alternately reversing directions and, by way of a speed reducer, drives the agitator of the washing machine according to the selected stroke profile.

14 Claims, 6 Drawing Sheets

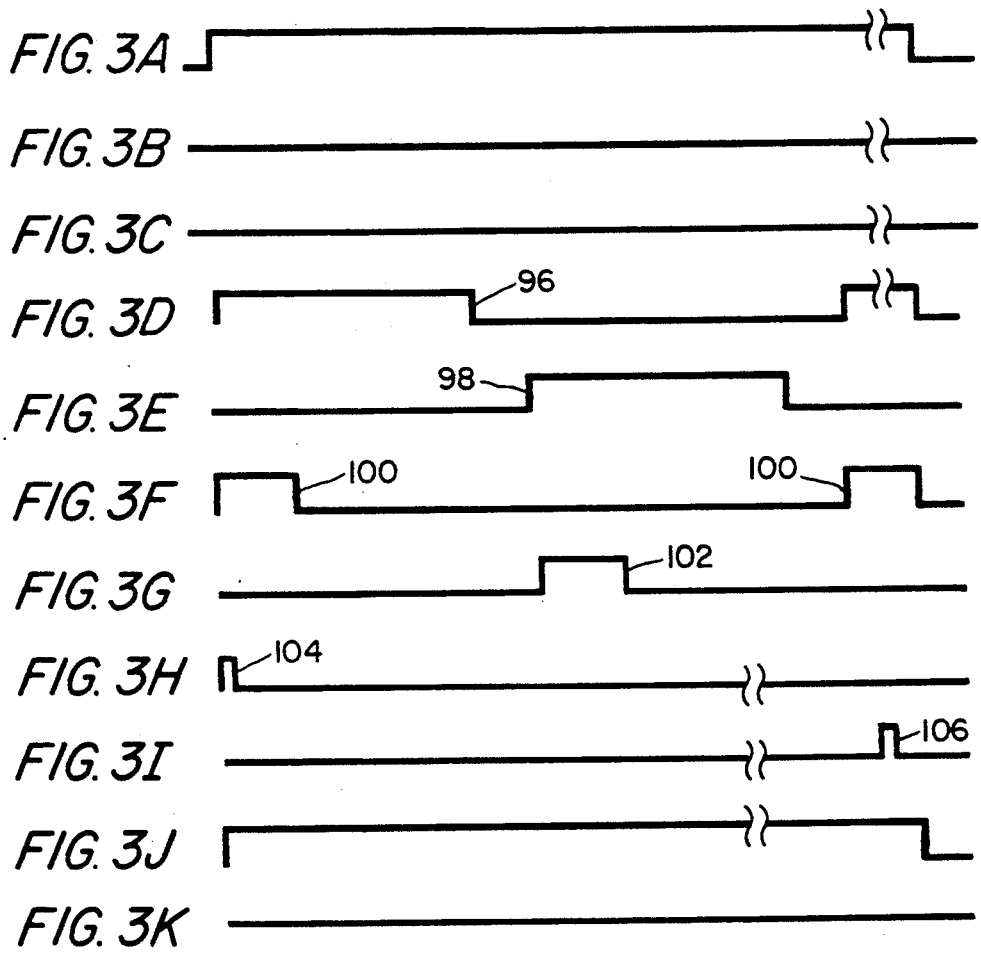
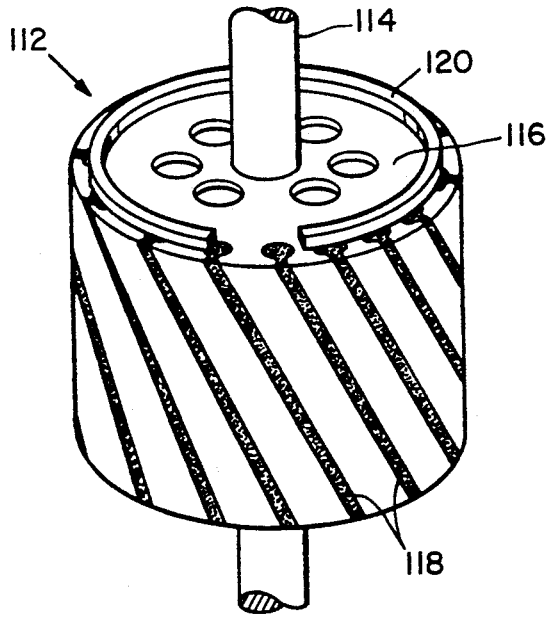
FIG. 4

CONTROLLER FOR WASHING MACHINE WITH ALTERNATELY REVERSING DRIVE MOTOR

BACKGROUND OF THE INVENTION

The field of the invention generally relates to washing machines, and more particularly relates to a controller for a washing machine having an alternately reversing drive motor.

Most commercially available, top-loading, agitator type washing machines use an electromechanical timer to control the washing machine automatically through various sequential operations such as water fill, agitate, soak, spin, spin and spray, pause, refill, etc. In the typical arrangement, an electromechanical timer includes a plurality of circumferential rows of timed cams on the outside of a cylinder that is slowly rotated by a small timer rotor. As the cylinder rotates, the cams push in a predetermined sequence against stacked rows of conductor fingers so as to open and close electrical contacts on the fingers. In such manner, the electromechanical timer distributes 120 VAC line voltage in a preprogrammed sequence to various electrical loads such as the motor run windings, the washing machine motor direction selector, and hot and cold water fill solenoids. Various other electrical devices such as an unbalance switch, a lid switch, and a water fill pressure switch are typically connected to the circuit of the electromechanical timer.

In operation, the operator typically first turns a rotary control knob that rotationally positions the electromechanical timer cylinder for the selected washing program such as, REGULAR, PERMANENT PRESS, or DELICATE. Then, upon pulling the control knob out, line voltage is distributed through the electromechanical timer by way of the water temperature selector to the hot and cold water solenoids of the water fill mixer valve. When a pressure sensitive switch toggles in response to the water being filled to a preselected level, the timer motor is energized and the timer cylinder starts to rotate thereby initiating agitation. To accomplish agitation, the electromechanical timer normally applies line voltage for a brief period of time to the resistance start winding of the induction drive motor, and then applies line voltage for the duration of the agitate cycle to the selected high or low speed winding of the motor to drive the input shaft of a reciprocating transmission in one direction. In response thereto, the transmission oscillates the agitator back and forth at a stroke rate such as, for example, 60 strokes per minute. Then, the electromechanical timer applies, line voltage to drive the motor in the opposite direction and, in response thereto, the transmission drives the clothes basket through a spin cycle. Subsequently, other operations such as rinse fill, agitate, and spin are executed under the control of the electromechanical timer in a similar manner to complete the selected washing program.

Electromechanical timers provide a relatively inexpensive and reliable way to distribute line voltage to various washing machine components in a sequentially timed manner so as to execute the preprogrammed operations of various washing programs. Also, electromechanical timers provide a convenient way of integrating control devices such as an unbalance switch, a lid switch, and a pressure fill switch. Further, manufacturers are very familiar with electromechanical timers and their circuits, and users are accustomed to the method and feel of selecting and activating electromechanical timers through the use of a rotary control knob. However, electromechanical timers are generally not suitable for use with a relatively new washing machine technology that uses an alternately reversing motor to eliminate the need for an expensive reciprocating transmission. More specifically, the cam opening and closing rate of conventional electromechanical timers is relatively slow such as, for example, one time every two seconds. However, to drive a reversing motor at a stroke rate such as, for example, 60 strokes per minute, the, line voltage drive to each of the respective stator windings of the motor must be switched at the relatively high rate of 2 times per second. Further, even if the cams of an electromechanical timer could be designed to open and close at a rate of 2 operations per second, the contacts would be subject to a relatively high failure rate. Also, advanced functions such as multiple agitator speeds, multiple spin speeds, and automatic out of balance compensation cannot be performed by a standard electromechanical timer. Such a timer includes no detection and decision making capability other than the decisions exhibited by the slow speed, contact-closing functions.

SUMMARY OF THE INVENTION

In accordance with the invention, there is provided a washing machine comprising a clothes basket having a clothes agitator, a reversible motor having first and second stator windings, means for linking the motor to the agitator, an electromechanical timer comprising means for switching a signal to an output terminal for a predetermined time duration corresponding to a cycle of the agitator, and means responsive to the signal for alternately switching line voltage to the first and second stator windings of the motor to drive the motor in alternately reversing directions wherein the switching rate of the alternately switching means is substantially faster than the switching rate of the electromechanical timer. The signal from the electromechanical timer may preferably be 120 VAC line voltage, and means may be provided between the timer and the alternately switching means for voltage level shifting the line voltage to a DC voltage compatible with the alternately switching means. Further, the signal from the electromechanical timer may comprise a plurality of lines collectively providing a binary encoded signal corresponding to a motor drive function. In a typical arrangement, the electromechanical timer may switch a signal ON for a duration up to 15 minutes corresponding to the length of an agitate cycle, and the alternately switching means may drive the agitator at a rate of 50–60 strokes per minute for that duration. Further, the alternately switching means may preferably provide motor off-time between motor reversals. For example, a typical stroke profile may be 0.4 seconds drive in one direction, 0.1 seconds off, 0.4 seconds drive in the opposite direction, and then 0.1 seconds off.

With such arrangement, the reversible motor is controlled by a rapidly switching means such as triacs gated by a microprocessor that preferably can be programmed to provide a wide variety of speed and reversing control functions. However, rather than doing away with a conventional electromechanical timer, such a timer is used to interface with and/or control electrical devices other than the motor, as well as to provide overall cycle control signals to the rapidly switching means. Thus, while this hybrid type circuit uses an electromechanical timer because it is low cost, reliable, familiar to manufacturers and users, and readily integrated into conventional washer circuits with other control switches and devices, the rapidly switching means provides the flexibility of driving an alternately reversing motor in a wide variety of programs and options.

BRIEF DESCRIPTION OF THE DRAWINGS

The foregoing objects and advantages of the invention will be more fully understood by reading the Description of the Preferred Embodiment with reference to the drawings wherein:

FIGS. 3A–K are control signals for the controller;

FIG. 4 is a perspective view of the rotor of the motor with end ring partially broken away;

DESCRIPTION OF THE PREFERRED EMBODIMENTS

Figure 1:
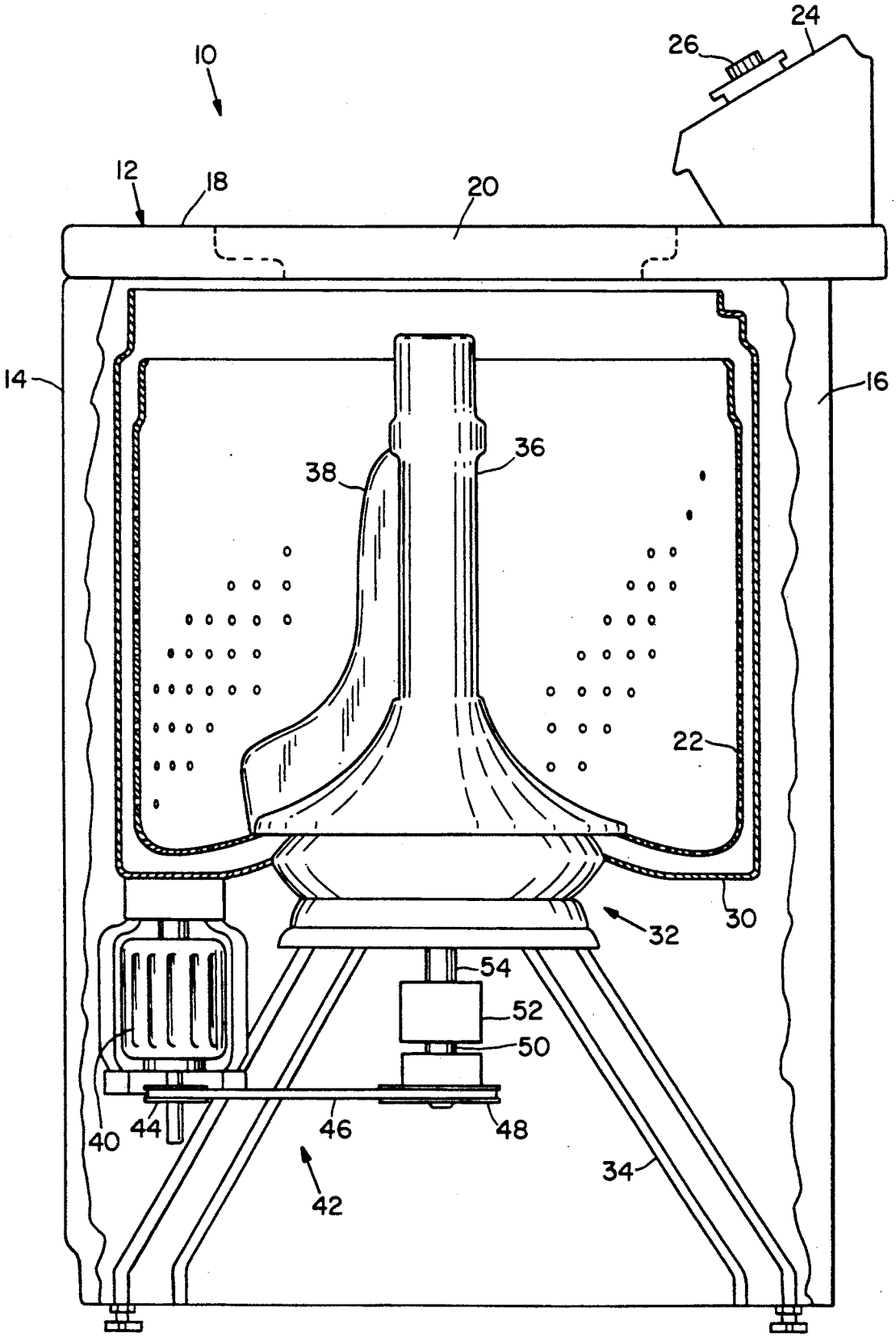
FIG. 1 is a partially broken away side view of a washing machine.

Referring specifically to FIG. 1, a top-loading, agitator type washing machine 10 has an outer cabinet 12 that includes a front panel 14, side panels 16, and a top panel 18 having an opening 20 through which clothes are loaded to and unloaded from a rotatable perforated clothes basket 22. A control console 24 is positioned at the rear of top panel 18, and includes a rotary control knob 26 that is interconnected to an electrical mechanical timer 28 (FIG. 2) which, as will be described in detail, automatically controls the washing machine 10 through a preprogrammed sequence of operations such as water fill, agitate, spin, and rinse fill.

Still referring to FIG. 1, perforated clothes basket 22 is positioned within tub 30 that is seated on a suspension 32 that is supported in spaced relationship from the bottom of the washing machine 10 by a plurality of legs 34. A vertically disposed agitator 36 having a plurality of vanes 38 is positioned within perforated clothes basket 22.

Motor 40 is suitably mounted below tub 30 and is connected by a pulley arrangement 42 including drive pulley 44, belt 46, and driven pulley 48 to the input shaft 50 of speed reducer 52 which, for example, may be a planetary gear drive. The output shaft 54 of speed reducer 52 is linked to agitator 36 and, in response to the alternately reversing drive of motor 40 during an agitate cycle, agitator 36 is oscillated back and forth about its vertical axis. In an alternate arrangement, a suitably designed motor 40 could be connected directly to shaft 54 such that pulley arrangement 42 and speed reducer 52 could be eliminated. As will be described in detail later herein, motor 40 is a permanent split capacitor (PSC) motor that has relatively high rotor resistance to provide relatively high starting torque and low starting current.

Figure 2:
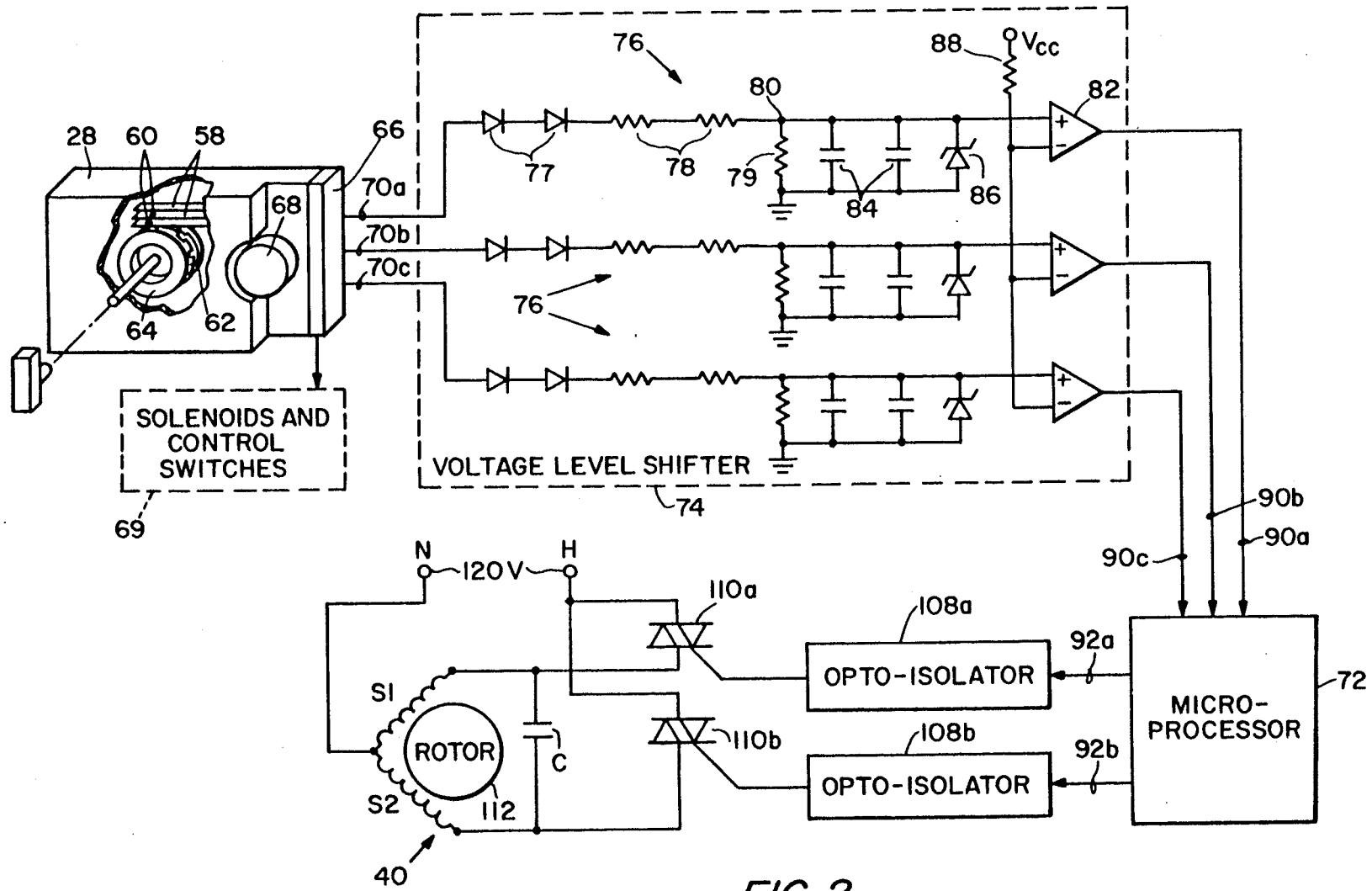
FIG. 2 is a schematic diagram of the controller for the washing machine.

Referring to FIG. 2, a conventional electromechanical timer 28 includes a plurality of stacked rows of conductor fingers 58 having contacts 60 that, in response to the timing cams 62 on plastic wheel 64, are opened and closed in a predetermined sequence to provide 120 VAC line voltage to terminal 66. More specifically, timer motor 68 operates to rotate wheel 64 and the timed cams 62 push against the conductor fingers 58 to open and close the switches of contacts 60 at preprogrammed times so as to energize the various washing machine components and thereby execute the various sequential washing operations. Terminal 66 of electromechanical timer 28 is connected to conventional solenoids and control switches 69 such as temperature selector switch, hot and cold water mixing valve solenoids, lid switch, pressure switch, and unbalance switch. In this manner, electromechanical timer 28 continues to carry on conventional interface and control functions to electrical devices with the exception of motor 40. Electromechanical timer 28 also provides control signals through terminal 66 to control lines 70*a–c* so as to indicate a specific operating mode for motor 40, and also to control the overall time duration. For example, a signal such as 120 VAC voltage or a DC voltage on line 70*a* could indicate a REGULAR wash stroke and a signal on line 70*b* could indicate a SPIN cycle; in both cases, the duration of the motor operation could, for example, be indicated by the duration of the signal. More preferably, the timer cams 62 on wheel 64 are modified from the conventional arrangement so as to provide an encoded (e.g. binary encoded) signal on lines 70*a–c*, which signal indicates the operating profile and/or duration for motor 40. The advantage of encoding the signal is, of course, that more information can be transmitted on fewer control lines. For example, the presence of an AC line voltage signal on line 70*a* and the absence of AC line voltage signals on lines 70*b* and 70*c* could indicate the selection of a REGULAR agitate cycle. Also, the presence of an AC line voltage signal on line 70*b* and the absence of AC line voltage signals on lines 70*a* and 70*c* could indicate the selection of a PERMANENT PRESS agitate cycle.

Although low voltage DC signals could be provided on lines 70*a–c*, here 120 VAC signals are provided and they are conditioned in voltage level shifter 74 so as to be compatible as inputs to microprocessor 72. More specifically, each line 70*a–c* is connected through respective identical circuits 76 in voltage level shifter 74 before being coupled to microprocessor 72. Each circuit 76 includes redundant series diodes 77 that rectify the AC line voltage signal, and redundant series resistors 78 that, in combination with resistor 79 to ground provide a voltage divider for junction 80 that is connected to the positive input of comparator 82. For example, each resistor 78 may be 22K ohms and resistor 79 may be 10K ohms. Redundant capacitors 84 and zener diode 86 are connected in parallel from junction 80 to ground; capacitors 84 provide filtering and zener diode 86 limits the positive input of comparator 82 to 5 volts DC. Vcc is connected through resistor 88 to the negative input of comparator 82 such that a DC reference voltage of, for example, 2.5 volts DC is provided. Thus, each threshold comparator 82 provides a buffered output such as approximately 5 volts DC on respective lines 80*a–c* whenever its corresponding input on lines 70*a–c* is 120 VAC.

Microprocessor 72 which may, for example, be a Motorola MC68HC0502 microncontroller, functions to decode the binary encoded control signal form electromechanical timer 28 on input lines 90*a–c*, and, in response thereto, to provide corresponding preprogrammed motor drive pulses on lines 92*a* and *b*. The table below is typical of the control function of microprocessor 72.

| CONTROL LINE a | b | c | MOTOR CYCLE | CYCLE DRIVE PROFILE (sec) |
|---|---|---|---|---|
| 0 | 0 | 0 | OFF | |
| 1 | 0 | 0 | REGULAR AGITATE | .4 CW, .1 OFF, .4 CCW, .1 OFF |
| 0 | 1 | 0 | PERM PRESS AGITATE | .15 CW, .6 OFF, .15 CCW, .6 OFF |
| 1 | 1 | 0 | DELICATE AGITATE | .075 CW, 1.425 OFF, .075 CCW, 1.425 OFF |
| 0 | 0 | 1 | HIGH SPEED SPIN | FULL POWER |
| 1 | 0 | 1 | LOW SPEED SPIN | HALF POWER |

For example, if the binary encoded signal 100 was output from electromechanical timer 28 on lines 70*a–c* and correspondingly onto control lines 90*a–c*, this, for example, would indicate the activation of a REGULAR agitate cycle having a duration so long as the encoded signal 100 was maintained. In response thereto, microprocessor 72 drives motor 40 in one direction 0.4 seconds, and, after 0.1 seconds off, drives motor 40 in the opposite direction 0.4 seconds followed by 0.1 seconds off. This stroke profile is then repeated for the duration of the cycle. Similarly, if control lines 90*a–c* are 010, a PERMANENT PRESS agitate cycle is called for, and that corresponds to driving motor 40 in one direction 0.15 seconds, 0.6 second OFF, 0.15 seconds in the opposite direction, and then 0.6 seconds OFF. As shown in the table, the control signal 110 calls for a DELICATE agitate wherein the reversing drive is 0.075 seconds intertimed by 1.425 seconds OFF. For HIGH SPEED SPIN, the motor 40 is driven unidirectionally with full power, and for LOW SPEED SPIN, it is driven at half power.

FIGS. 3A–C show inputs to microprocessor 40 on lines 90*a–c*, respectively, for a REGULAR agitate cycle, and FIGS. 3D–E show the resulting outputs on control lines 92*a* and *b*, respectively. Specially, in response to electromechanical timer 28 switching 120 VAC line voltage to line 70*a*, line 90*a* goes HI. Although other methods could be used, electromechanical timer 28 does not switch the 120 VAC line voltage off line 70*a* until the completion of the scheduled REGULAR agitate cycle, and this typically may occur 5–15 minutes later. As shown, line voltage is not applied to lines 70*b* and *c*. For the duration of applying 120 VAC to line 70*a*, microprocessor 72 switches lines 92*a* and 92*b* at a much faster rate that is suitable for rapidly driving a reversing motor in the heretofore described application. A 0.4 second gating pulse 96 is applied to line 92*a*, and the, after a 0.1 second off interval, a 0.4 second gating pulse 98 is applied to line 92*b*. This gating sequence is then continued for the 5–15 minutes that electromechanical timer 28 applies line voltage to line 70*a*. In other words, electromechanical timer 28 provides a higher level command or control signal for motor 40 and, in response thereto, microprocessor 72 generates much faster control signals that execute the called for function.

FIGS. 3F and 3G show the control pulses 100 and 102 on lines 92*a* and *b*, respectively, that carry out a PERM PRESS agitate cycle. The pulses have a duration of 0.15 seconds with OFF time 0.6 seconds inbetween. FIGS. 3H and 3I show the control pulses 104 and 106 on lines 92*a* and *b*, respectively, that carry out a DELICATE agitate cycle. The pulses have a duration of 0.075 seconds with OFF time 1.425 seconds inbetween. FIGS. 3J and 3K show the states of lines 92*a* and 92*b*, respectively, that carry out a HIGH SPEED SPIN. Line 92*a* is HI and 92*b* is LO. Although the rapid speed switching control is shown and described as microprocessor 72, other equivalent electronic or memory circuits could be used. Further, not all of the possible logic states on lines 90*a–c* have been used, and it is recognized that other motor drive algorithms could be implemented. Also, additional control lines could be used to indicate the duration of a cycle to microprocessor 72 in advance. In other words, the programmability and the rapid switching rate of microprocessor 72 can be used to provide many motor control options and flexibility.

Referring again to FIG. 2, lines 92*a* and *b* are connected to respective opto-isolators 108*a* and *b* that gate respective triacs 110*a* and *b*, or other similar high power switches. Accordingly, in response to a pulse on line 92*a*, triac 110*a* is turned on and 120 volts AC is applied to winding S1 of PSC motor 40 thereby driving the rotor 112 in one direction, here clockwise for convention. Conversely, a pulse on line 92*b* turns on triac 110*b* and 120 volts AC is applied to stator winding S2 of PSC motor 40 thereby driving rotor 112 in the counter clockwise direction for the duration of the pulse. As is well known, the permanent split capacitor C provides the phase difference between stator windings S1 and S2.

Referring to FIG. 4, the rotor 112 of the PSC motor 40 includes a shaft 114 about which is built up a core 116 of insulated steel laminations. In conventional arrangement, a plurality of individual parallel metal bars 118, typically cast aluminum, are embedded in the surface of core 116. End rings 120, here partially broken away, connect to the ends of the bars 118 and complete electrical circuits between individual bars 118. As is well known, the phase displaced by capacitor C in stator winding S1 versus stator winding S2 creates a moving field around rotor 112. This moving field induces currents in the bars 118 of the rotor 112. The currents so induced create a magnetic field that reacts against the rotating field set up by the stator winding thereby producing a torque on the rotor 112. A relatively high rotor resistance R has been provided to increase starting torque and also to draw less starting current so as to generate less heat in this relatively rapid stroke rate and quick motor reversal application. In one embodiment, the rotor resistance R of the commercially available reversing washing machine motor described in the Background was increased by machining down the rotor end rings 120. Specifically, the high rotor resistance was achieved by machining off the rotor fan blades and reducing the end rings to an outer diameter of 2.580", and inner diameter of 2.225", and a thickness of 0.041" thereby reducing the ring conduction thickness to about one-third of its original thickness.

Figure 5A:
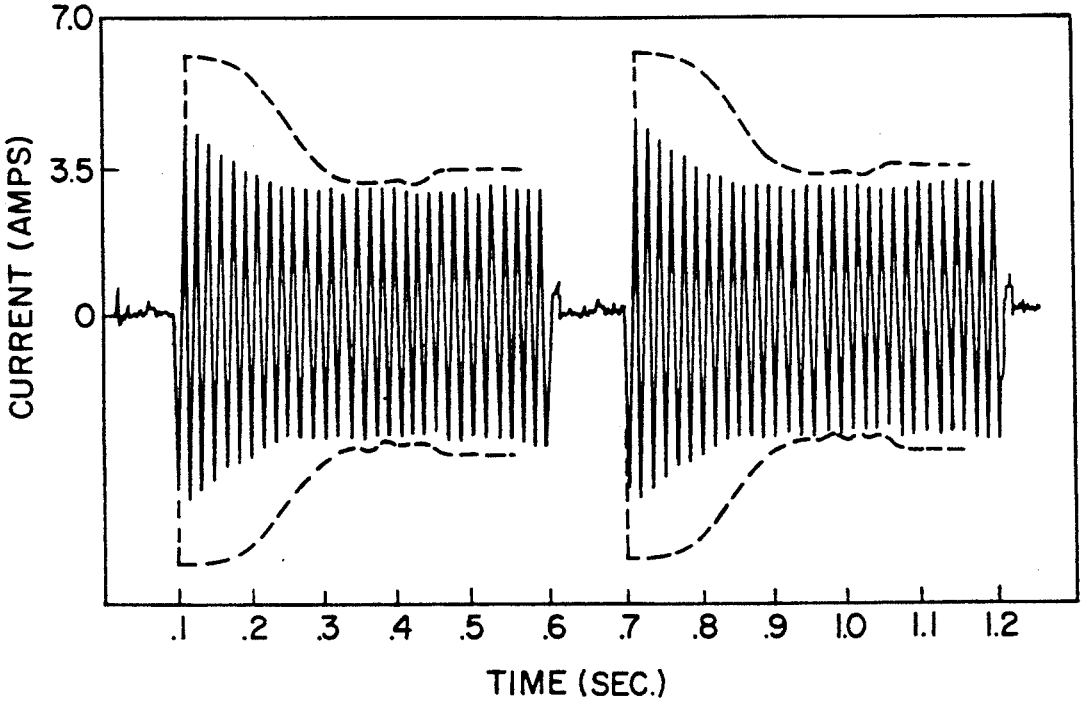
FIG. 5A is the current tracing on the neutral motor lead for a 14 lb. load using a high resistance rotor, and the dotted line shows the envelope for the current tracing of a standard low resistance rotor.

FIG. 5A shows the current tracing on the neutral lead of motor 40 with 0.5 seconds reversing drive pulses for the modified high resistance rotor 112 with a 14 lb. load in clothes basket 22. The dotted line in FIG. 5A shows the current tracing envelope under the same conditions for the same motor in its commercially-available configuration with low rotor resistance before machining. The unmodified motor with low rotor resistance spends approximately 0.2 seconds of the 0.50 second energization in the high current draw, low speed region while the high resistance rotor tracing shows both reduced time and lower current draw in this high current draw regions. Further, the peak starting current draw for the low resistance rotor was approximately 6.5 amps and, as shown, the peak starting current draw for the high resistance rotor was significantly lower. As would be expected from these tracings, the modified high rotor resistance motor operated at a lower steady state temperature. Specifically, the steady state temperature of the high rotor resistance motor was 168° F. while the unmodified low rotor resistance motor was 180° F.

Figure 5B:
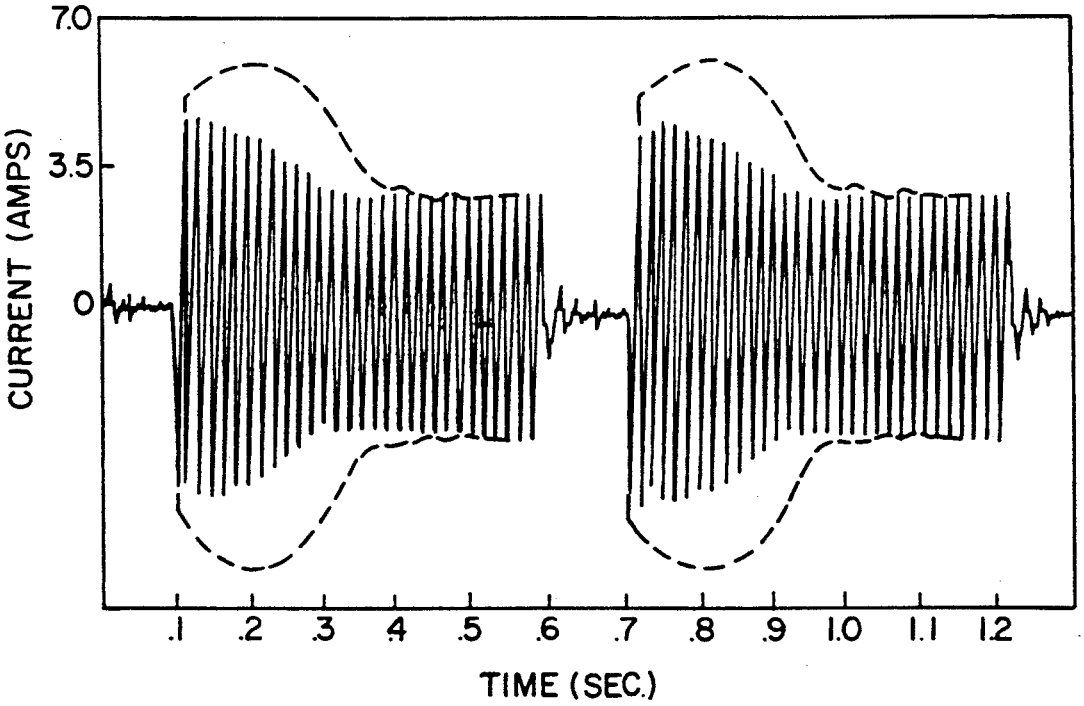
FIG. 5B shows a current tracing similar to FIG. 5A with a 4.6 lb. clothes load.

FIG. 5B shows similar tracings for the high rotor resistance motor versus the unmodified low rotor resistance motor with a 4.6 lb. clothes load. Under this operating condition, the high current draw region of the low rotor resistance motor was approximately 0.27 seconds while, as shown, the high rotor resistance motor was approximately 0.20 seconds. Also, the peak starting current of the low rotor resistance motor was approximately 6.3 amps and occurred approximately 0.1 seconds after initiation of the drive pulse. As shown, the peak starting current of the high resistance motor was significantly lower. The steady state temperature of the high rotor resistance motor was 178° F. while the unmodified motor was 205° F. The respective motor configurations may have run hotter with the lighter clothes load because the agitator 36 did not have enough drag to come to a complete stop in the 0.1 second motor OFF period before reversing, and therefore, when the motor was reversed, current was drawn in stopping the motor before it could be reversed in direction. In other words, the motor was reversing against itself.

PSC motors from several different manufacturers were studied to determine what effect increasing the resistance of rotor 112 would have on the steady state operating temperature of the motor 40 in a high stroke rate, such as 60 strokes per minute, reversing motor application. It was found that up to some limit, the operating temperature of the motors in the washing machine reversing motor application was decreased as the rotor resistance was increased. This was done without modifying the stator windings S1 and S2. Although all of the reasons for the lower operating temperature may not be easily quantized, it is well known that a low rotor resistance provides high efficiency under normal running conditions, but low rotor resistance also results in low starting torque and high starting current at a low starting power factor. Therefore, by increasing the rotor resistance, the starting torque may be increased and the starting current may be decreased at the expense of lower efficiency at higher speed. As is well known, the heat of a motor results from the $I^2R$ losses. Accordingly, by decreasing the starting current, less heat is generated in the stator windings while starting the motor, and this is a critical period for heating the motor because the starting current is substantially higher than the running current, and the effect of the fan is minimal. Also, by increasing the starting torque, less time is spent in the relatively high heat generating starting condition in getting up the speed. Simply stated, for the rapid stroke rates and quick motor reversals of this particular washing machine reversing motor application, the improved starting torque and reduced starting current draw appear to more than offset less efficient higher speed operation. In this particular motor reserving application, the motor 40 spends a significant percentage of time starting the motor, and it is advantageous to optimize the rotor resistance for this relatively high thermal loading condition.

Figure 6:
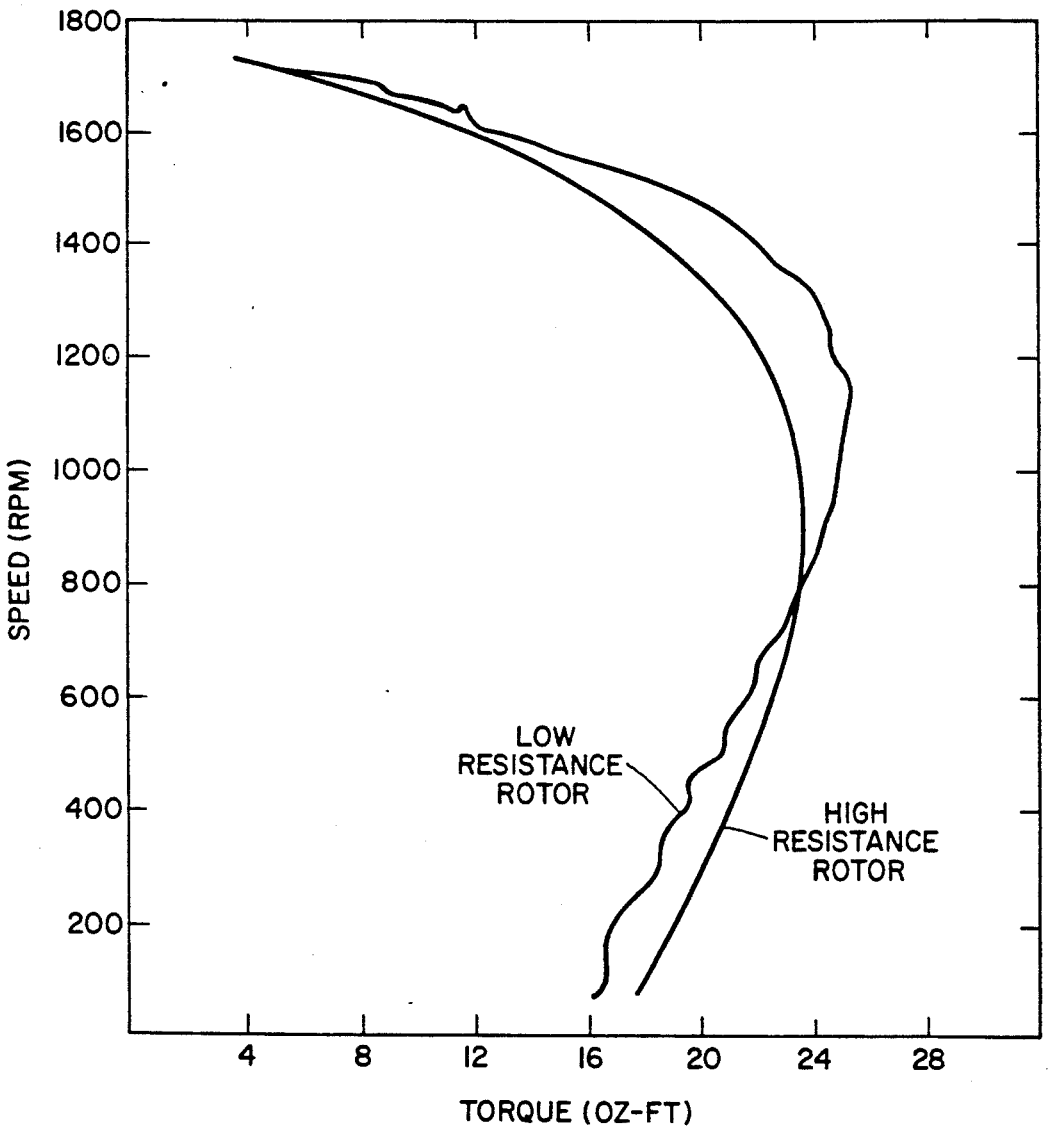
FIG. 6 is a torque/speed curve for respective motors having high and low resistance rotors.

Referring to FIG. 6, torque/speed curves are shown for one particular motor design with high rotor resistance and with low rotor resistance, as labeled. Specifically, the height of the end ring 120 before modification was 0.153", and the end ring 120 was machined down to 0.050" resulting in an increase in rotor resistance from 11 ohms to 35 ohms. As can be seen, the high rotor resistance motor has higher starting torque and therefore, in addition to drawing less starting current, also spends less time in the critical high thermal loading operation getting up to running speed. In bench tests, the unmodified low rotor resistance motor drew 6.0 locked rotor amps and 2.17 idle amps, and had 12.0 OZ-ft locked rotor torque. In contrast, the modified high rotor resistance motor drew 5.4 locked rotor amps and 2.19 idle amps, and had 14.7 OZ-ft locked rotor torque. The above measurements were made with a hot motor. The ratio of locked rotor amps to idle amps of the modified high rotor resistance motor was 2.76, while the unmodified motor was 2.46.

Figure 7:
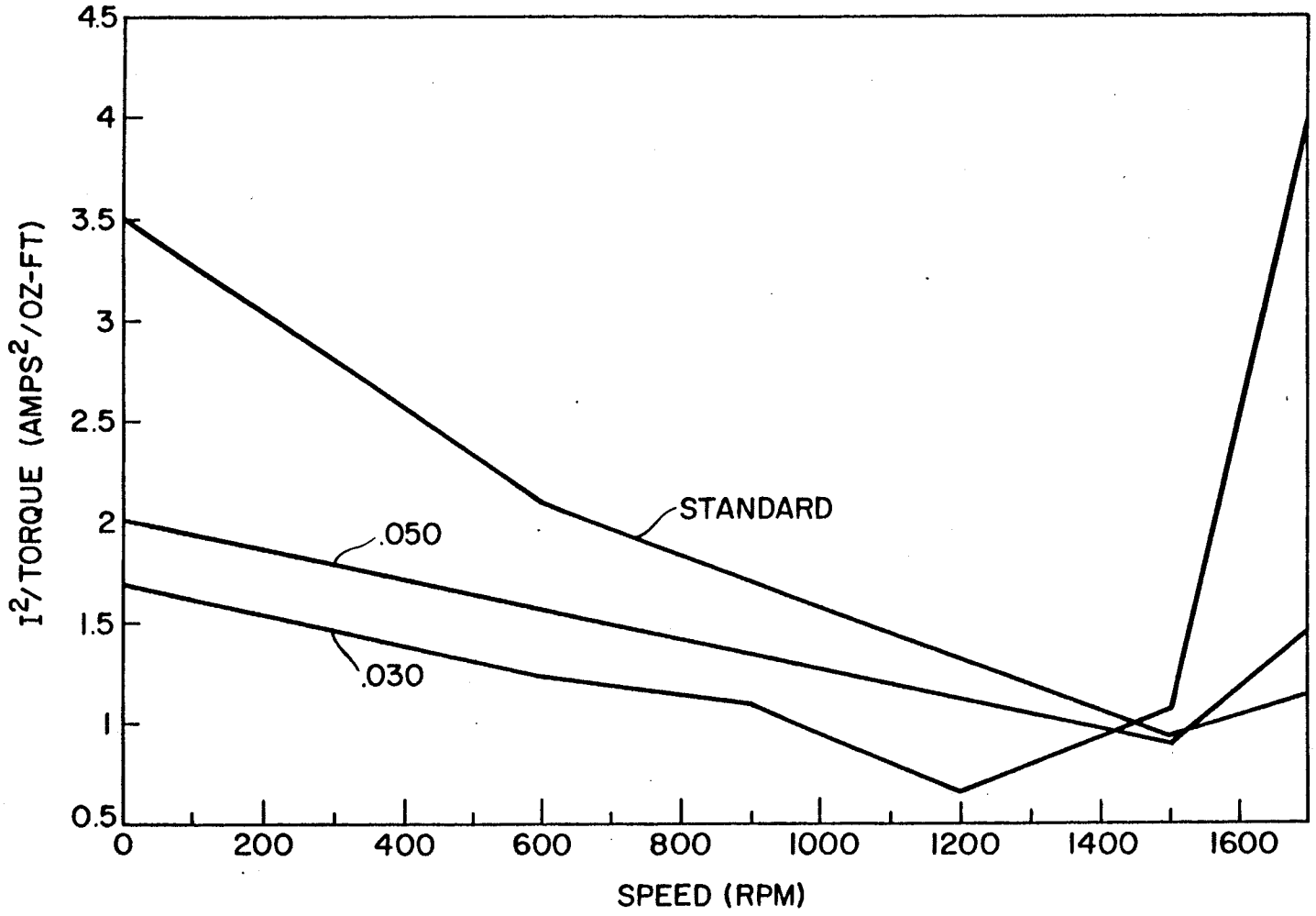
FIG. 7 is a speed versus $I^2$/torque curve for standard and high rotor resistance motors.

With reference to FIG. 7, $I^2$/torque vs. speed curves are shown for the FIG. 6 motors having the standard low resistance rotor and the modified 0.050" high resistance rotor. Also, a similar curve is shown with the rotor machined down to 0.030". $I^2$/torque is a quality factor corresponding to the ability of the motor 40 to develop torque at low loss. As can be seen, the $I^2$/torque start-up factor for the standard or unmodified low rotor resistance motor is much higher than the motors with high rotor resistance. Further, in the region or range up to 600 rpms, the standard motor continues to have a $I^2$/torque factor significantly higher than the high rotor resistance motors, and 0.050" motor has an $I^2$/torque factor slightly higher than the 0.030" motor. Accordingly, in this range, the standard or low rotor resistance motor has much higher $I^2R$ losses and therefore generates substantially more heat per unit of torque. In the operating region or range from 600 rpms to approximately 1500 rpms, the standard or low rotor resistance motor continues to have an $I^2$/torque factor higher than either high rotor resistance motor, but the curves generally converge at approximately 1500 rpms where all three motors have approximately the same $I^2$/torque factor. As shown, the $I^2$/torque factor of the motor with a 0.030" rotor end ring rapidly degrades above 1500 rpms, while the $I^2$/torque factor of the motor with a 0.050" rotor end ring degrades less rapidly, but is still higher than the standard or low rotor resistance motor.

Those skilled in the art will recognize that the resistance of a rotor can be increased by techniques other than reducing the cross-sectional area of the end rings 120. For example, the conductivity of the bars 118 can be reduced by using different materials, or by adding impurities to the material being used.

This completes the Description of the Preferred Embodiments. However, a reading of it by those skilled in the art will bring to mind many alterations and modifications that do not depart from the spirit and scope of the invention. Accordingly, it is intended that the scope of the invention be limited only by the appended claims.

What is claimed is:

1. A washing machine comprising:

a clothes basket having a clothes agitator;

a reversible motor having first and second stator windings;

means for linking said motor to said agitator;

an electromechanical timer having a plurality of switches actuated by a rotatable cylinder with timed cams, said electromechanical timer comprising means for switching a signal to an output terminal for a predetermined time duration corresponding to a cycle of said agitator;

means responsive to said signal for alternately switching line voltage to said first motor in alternately reversing directions, said alternately switching means comprising a microprocessor providing a switching rate substantially faster than the switching rate of said electromechanical timer; and said signal from said electromechanical timer comprising voltages on a plurality of lines collectively providing a binary encoded signal corresponding to a motor stroke profile.

2. The washing machine recited in claim 1 wherein said signal from said electromechanical timer is 120 VAC line voltage, and said washing machine further comprises means connected between said timer and said alternately switching means for voltage level shifting said 120 VAC line voltage to a DC voltage compatible with said alternately switching means.

3. The washing machine recited in claim 1 wherein said signal from said electromechanical timer comprises a plurality of lines collectively providing a binary encoded signal corresponding to a motor stroke profile.

4. The washing machine recited in claim 3 wherein one of said motor stroke profiles comprises driving said agitator in one direction for 0.4 seconds, deactivating for 0.1 seconds, driving in the opposite direction for 0.4 seconds, and then deactivating for 0.1 seconds.

5. A washing machine comprising:

a clothes basket having a clothes agitator;

a reversible motor having first and second stator windings;

means for linking said motor to said agitator;

an electromechanical timer having a plurality of switches actuated by a rotatable cylinder with timed cams, said electromechanical timer comprising means for providing an encoded signal corresponding to a selected one of a plurality of stroke profiles for said agitator, said encoded signal comprising line voltage switched to predetermined ones of a plurality of control lines;

means for decoding said encoded signal and, in response thereto, for alternately switching line voltage to said first and second stator windings of said motor to drive said motor and said agitator in alternately reversing directions in accordance with said encoded signal to provide said selected one of said plurality of stroke profiles.

6. The washing machine recited in claim 5 further comprising means for shifting said line voltages on said control lines to DC voltages having voltage levels compatible with said decoding means.

7. The washing machine recited in claim 5 wherein said decoding and alternately switching means comprises a microprocessor.

8. The washing machine recited in claim 7 wherein said alternately switching means further comprises opto-isolators.

9. The washing machine recited in claim 8 wherein said alternately switching means further comprises triacs gated by said opto-isolators.

10. The washing machine recited in claim 5 wherein said motor is a permanent split capacitor motor.

11. A washing machine comprising:

a clothes basket having a clothes agitator;

a reversible motor having first and second stator windings;

means for linking said motor to said agitator;

an electromechanical timer having a plurality of switches actuated by a rotatable cylinder with timed cams, said electromechanical timer comprising means for providing an encoded signal corresponding to a selected one of a plurality of operational stroke profiles for said motor, said providing means comprising means for switching line voltage to predetermined ones of a plurality of control lines;

means for voltage level shifting said line voltage on said predetermined control lines; and means responsive to said voltage level shifting means for decoding said encoded signal and, in response thereto, for alternately switching line voltage at a rate faster than said switching means for said electromechanical timer to said first and second stator windings to drive said motor in alternately reversing directions to provide said selected one of said plurality of operational stroke profiles.

12. The washing machine recited in claim 11 wherein said decoding and alternately switching means comprises a microprocessor.

13. The washing machine recited in claim 11 wherein said alternately switching means comprises triacs gated by opto-isolators.

14. The washing machine recited in claim 11 wherein said motor comprises a permanent split capacitor motor.

* * * * *